US005557993A

United States Patent [19]

Austin

[11] Patent Number: 5,557,993

[45] Date of Patent: Sep. 24, 1996

[54] SLIDE ACTUATING MECHANISM FOR OPEN-END ADJUSTABLE WRENCH

[76] Inventor: Kelly P. Austin, 3712 Cragmont Ave., Dallas, Tex. 75205

[21] Appl. No.: 510,544

[22] Filed: Aug. 2, 1995

[51] Int. Cl.[6] ..... B25B 13/16

[52] U.S. Cl. ..... 81/165; 81/170

[58] Field of Search ..... 81/129, 165, 170, 81/172

[56] References Cited

U.S. PATENT DOCUMENTS

| | | | |
|---|---|---|---|
| 3,368,432 | 2/1968 | Halls | 81/165 |
| 3,541,899 | 11/1970 | Tanner | 81/165 |
| 3,555,939 | 1/1968 | Halls | 81/165 |
| 3,640,159 | 2/1972 | Halls et al. | 81/165 |
| 3,673,896 | 7/1972 | Vardaman | 81/165 |
| 3,901,107 | 8/1975 | Halls | 81/170 |
| 4,028,970 | 6/1977 | Pelczar | 81/165 |
| 4,046,034 | 9/1977 | Flwelling | 81/165 |
| 4,766,786 | 8/1988 | Jeremic | 81/129 |
| 4,907,476 | 5/1990 | Singleton | 81/57.29 |
| 4,913,007 | 4/1990 | Reynolds | 81/57.29 |

*Primary Examiner*—James G. Smith
*Attorney, Agent, or Firm*—John E. Reilly

[57] ABSTRACT

An adjustable open-end wrench of the type having fixed and movable jaws at one end with a worm gear for advancing the movable jaw toward and away from the fixed jaw includes a slide-type actuating mechanism in the handle made up of thumb buttons which are assembled in elongated slots on opposite sides of the handle to engage a helical shaft and impart rotation to the shaft and to a complementary bevel gear which engages the bevel gear on the worm to cause opening and closing movement of the movable jaw.

11 Claims, 1 Drawing Sheet

SLIDE ACTUATING MECHANISM FOR OPEN-END ADJUSTABLE WRENCH

BACKGROUND AND FIELD OF INVENTION

This invention relates to adjustable wrenches; and more particularly relates to a novel and improved adjusting mechanism for open-end wrenches of the crescent type.

Crescent wrenches employ a movable jaw at one end which can be loosened or tightened by rotation of a worm gear associated with the movable jaw by grasping between a finger and thumb. It has been proposed in the past to employ a slide mechanism in the handle of the wrench which operates through a helical shaft to cause rotation of the worm and, for example, reference is made to U.S. Pat. No. 3,555,939 to K. F. Halls. In Halls, the helical shaft; in the handle has a bevel gear at one end which intermeshes with a bevel gear at the end of the worm, and the slide mechanism includes a thumb button control which is assembled in an elongated slot along one side of the handle to engage the helical shaft and impart rotation by advancing along the slot.

Wrenches of this type which have been designed in the past have suffered certain drawbacks owing to a tendency of the thumb button to jam and, at least in certain sizes of wrenches, is not capable of imparting sufficient rotational force through the helical shaft to adequately tighten the movable jaw. Moreover, wrenches with a single thumb button control are typically designed for right-hand use only and cannot be effectively used by a left-handed person.

Accordingly, it is proposed to overcome problems associated with adjustable jaw wrenches of the type described by devising a slide mechanism which can be operated or manipulated from either or both sides of the handle and in such a way as to minimize the possibility of jamming or inadequate tightening but nevertheless enable use in close quarters. Most importantly, however, greater leverage can be effected while enabling use of the wrench by either hand.

Other representative patents in this field are U.S. Pat. Nos. 3,368,432 to K. F. Halls, 3,541,899 to J. H. Tanner, 3,640,159 to K. F. Halls et al, 3,673,896 to H. W. Vardaman, 3,901,107 to K. F. Halls, 4,046,034 to H. J. Fiewelling, 4,766,786 to M. Jeremic, 4,907,476 to R. P. Singleton and 4,913,007 to R. W. Reynolds.

SUMMARY OF THE INVENTION

It is therefore an object of the present invention to provide for a novel and improved adjustable jaw wrench of the type employing a slide mechanism in the handle which can be effectively operated with either hand.

It is another object of the present invention to provide in an adjustable jaw wrench for a novel and improved adjusting mechanism in the handle which may be efficiently manufactured and assembled in a minimum number of steps while achieving increased leverage in the operation of the wrench.

It is a further object of the present invention to provide in an adjustable wrench for an improved slide-type actuating mechanism in the handle which is capable of increased range of motion of the jaw thereby reducing the number of different wrench sizes.

In accordance with the present invention, there has been devised an actuator mechanism for an open-ended, adjustable jaw wrench of the type having an elongated handle with a fixed jaw at one end and a movable jaw controlled by a worm gear for advancing the movable jaw toward and away from the fixed jaw, the actuator mechanism comprising an elongated cavity in the handle, a shaft having a helical groove rotatably supported within the cavity including a drive gear at one end engageable with the worm gear and a bearing member at an opposite end, the handle including elongated slots extending along opposite sides of the cavity, and a thumb button actuator member which is insertable into each of the slots for engagement with the helical groove whereby movement of the actuator member along the slots will impart rotation to the drive shaft and drive gear to rotate the worm gear. In a preferred form of invention, the helical shaft has a pair of helical grooves so that the actuator members are aligned in diametrically opposed relation to one another when inserted into engagement with a respective helical groove. In a modified form, a single helical groove is employed and the thumb button actuator members are slightly offset from one another in an axial direction in order to engage diametrically opposed surfaces of the groove.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 2:
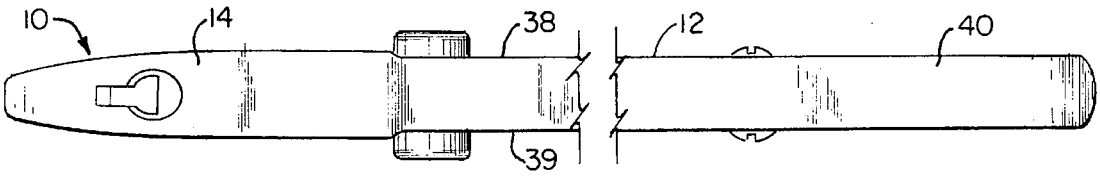
FIG. 2 is a top plan view of the form of invention shown in FIG. 1.
Figure 1:
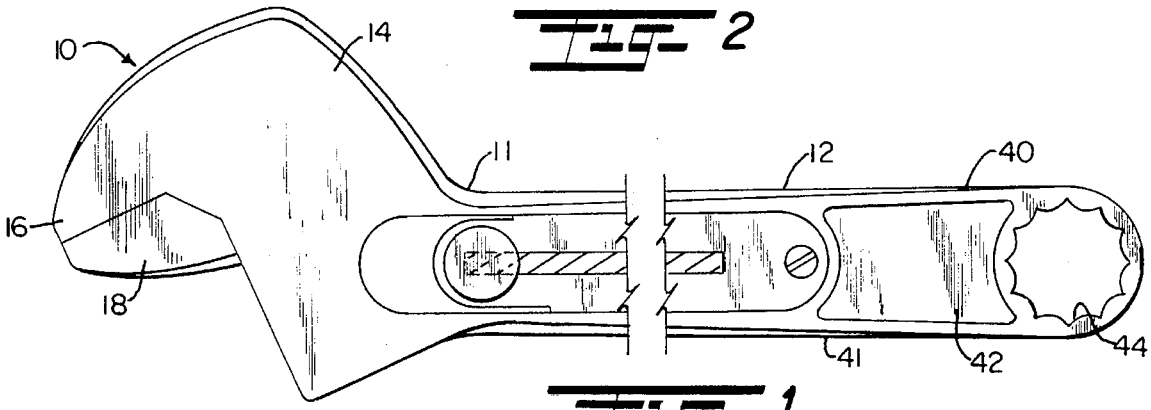
FIG. 1 is a front view in elevation of one preferred form of crescent wrench in accordance with the present invention.
Figure 3:
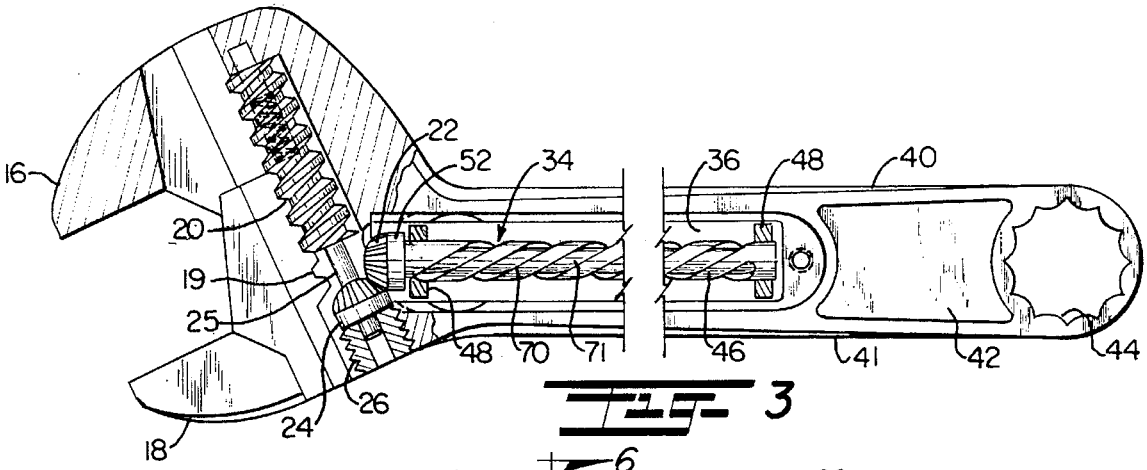
FIG. 3 is a front view partially in section of the form of invention shown in FIGS. 1 and 2.

Referring in more detail to the drawings, there is illustrated in FIGS. 1 to 4 a preferred form of crescent wrench 10 in which a one-piece body 11 is made up of an elongated handle 12 and a head 14 projecting from one end to define a fixed jaw 16. Cooperating with the fixed jaw is a movable jaw 18 disposed for slidable movement on the head 14 toward and away from the fixed jaw under the control of a worm 20. The worm 20 is supported at one end on a spring-loaded bearing 21 within a cavity 22 behind the jaws 16 and 18 to intermeshingly engage with a complementary, toothed side 19 of the jaw 18 in response to rotation of the worm 20. In order to impart rotation to the worm 20, a shaft 25 forms an axial continuation of the worm with a bevel gear 24 mounted on the shaft, and an end of the shaft 25 projecting beyond the bevel gear 24 is journaled in a hollow bore extending through a set screw 26 which is positioned in one end of the cavity 22. Preferably, the bevel gear 24 is of semi-spherical configuration and is seated against the screw 26 by insertion of the shaft 25 as described and yieldingly urged against the screw 26 by the spring-loaded bearing member 21.

In order to control rotation of the worm 20 and movement of the movable jaw 18 toward and away from the fixed jaw, an actuating mechanism 34 is housed in an elongated open cavity 36 in the handle 12, the cavity 36 communicating with the cavity 22 and extends centrally through the handle 12 for a predetermined length to be hereinafter described. The handle 12 as well as the head 14 has spaced parallel sides 38, 39 and opposed top and bottom edges 40 and 41. In accordance with conventional practice, the sides 38, 39 are somewhat inset as at 42 and provided with a circular opening 44 at the distal end away from the head 14.

The actuating mechanism 34 includes a helical shaft 46 journaled at opposite ends in collars 48 at opposite ends of a cover plate 50, and a bevel gear 52 is mounted at and fixed to one end of the shaft 46 just beyond one of the collars 48. As noted, the collars 48 project inwardly from opposite ends of the cover plate 50, and the cover plate 50 is seated in a shallow recess 52 in one side 38 of the handle bordering the cavity 36 and anchored by means of a suitable fastener, such as, screw 51. An elongated slot 54 extends centrally along the cover plate 50 and is substantially coextensive with the helical shaft 46 between the collars 48 and aligned with the helical shaft to receive a thumb button actuator member 55. The actuator member 55 includes a boss or pin 56 projecting through the slot 54, and a snapping or keeper 58 retains the boss 56 in engagement with a helical groove in the shaft 46 to be hereinafter described.

A second elongated slot 60 is disposed in a second cover plate 62 on the opposite side 39 of the handle and which slot 60 is coextensive with the slot 54 and with the helical shaft 46 between the collars 48. A second thumb or slide button actuator member 64 is provided with a pin 65 and retained by a snap ring 66 in the slot 60 for engagement with a helical groove on the shaft 46 in diametrically opposed relation to the pin 56. The cover plate 62 is similarly seated in a recess 68 and anchored by a screw 69 in the same manner as described with respect to the cover plate 50.

In the preferred form, the helical shaft 46 preferably includes a pair of helical grooves 70 and 71 which are of a corresponding pitch and coextensive with one another along the substantial length of the shaft 46 between the collars 48.

The grooves 70, 71 are of a pitch and so aligned that the pins 56 are aligned on a common longitudinal axis through the pins when the pins are inserted into the respective grooves 70 and 71 so that when the buttons 55 and 64 are advanced along their respective slots will simultaneously apply a rotational force to the shaft; or, either button 55 or 64 may be individually engaged by a thumb or finger to rotate the helical shaft 46.

The bevel gear 52 at the end of the shaft 46 is of generally semi-spherical configuration and complementary to the bevel gear 24 so as to impart rotation to the bevel gear 24 and worm 20 when the helical shaft 46 is rotated thereby causing the movable jaw 18 to move either toward or away from the fixed jaw 16 according to the direction of rotation of the shaft 46. Thus, when the shaft 46 is rotated in a clockwise direction, as viewed from the rear or distal end of the wrench, when one or both of the buttons 55, 64 is advanced toward the head 14 the movable jaw 18 will be advanced in a closing direction toward the fixed jaw 16. Conversely, when one or both of the actuating members 55 or 64 is retracted to reverse the rotation of the shaft 46 in a counterclockwise direction will cause the movable jaw 18 to be opened. The extent of movement or expansion of the movable jaw is regulated primarily by the length of the helical shaft 46 and by the length of the toothed side of the jaw 18. However, the bevel gears 24 and 52 by virtue of their generally spherical configuration will enable a full range of motion through greater than 360° and not impose any limitation on the degree of opening and closing of the jaw 18.

DETAILED DESCRIPTION OF MODIFIED FORM OF INVENTION

Figure 5:
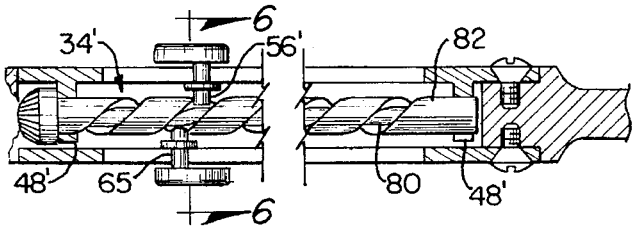
FIG. 5 is a sectional view taken through a portion of a modified form of actuating mechanism.
Figure 6:
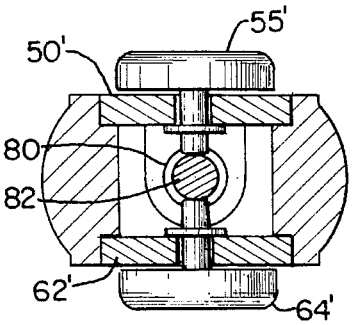
FIG. 6 is a cross-sectional view taken about lines 6—6 of FIG. 5.
Figure 4:
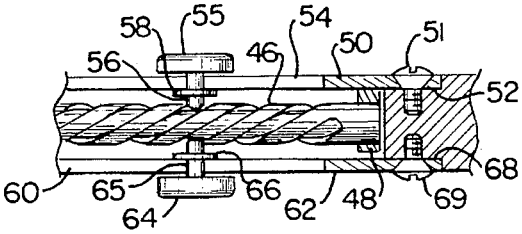
FIG. 4 is a sectional view taken through a portion of the actuating mechanism shown in FIG. 3.

There is illustrated in FIGS. 5 and 6, a modified form of actuating mechanism 34' in which like parts are correspondingly enumerated with prime numerals to those of the preferred form of FIGS. 1 to 4. As in the preferred form, cover plates 50' and 62' are anchored on opposite sides of the cavity 36' and slide button actuating members 55' and 64' are arranged for slidable advancement along the respective slots 54' and 60' to engage diametrically opposed surfaces of a single helical groove 80 in a shaft 82. As in the preferred form, the shaft 82 is journaled in collars 48' at opposite ends of the cover plate 50' but, owing to the use of a single helical groove, requires that the actuating members 55' and 64' engage the groove 80 in slightly axially displaced relation to one another. For this reason, the pins 56' and 65' are offset away from the center of their respective buttons so that the buttons themselves will remain aligned with one another. It will be apparent that it is not essential that the buttons 55' and 64' be aligned opposite to one another and, for example, may employ the buttons 55 and 64 of the preferred form in which event the buttons and their pins 56 and 65 would be offset as described. In the modified form, either button 55' or 64' may be grasped by a thumb or finger to impart rotation to the shaft 82; or the buttons 55' and 64' may be simultaneously grasped or engaged to slidably advance along their respective slots 54' and 60'. Further, it will be evident both with respect to the preferred and modified forms of invention that the cover plate 62 or 62' may be welded to or otherwise form a unitary part of the handle, and the buttons 64, 64' can be assembled with respect to the slot 60 or 60', respectively, prior to assembly of the helical shaft 46 or 46' and its associated cover plate.

The body 11 of the wrench may be forged or cast so as to be of one-piece construction as described other than the movable jaw 18 and actuating mechanism 34 or 34'. The actuating mechanism is separately assembled and then anchored into position in the handle of the wrench so that the bevel gear 52' is properly aligned in intermeshing engagement with the bevel gear 24', and any necessary or appropriate adjustment between the gears can be made by threaded adjustment of the screw 26'.

It is therefore to be understood that while preferred and modified forms of invention have been herein set forth and described, the above and other modifications may be made in the construction and arrangement of parts comprising the invention without departing from the spirit and scope thereof as defined by the appended claims and any reasonable equivalents.

I claim:

1. In an open-ended, adjustable jaw wrench wherein an elongated handle has a fixed jaw at one end and a movable jaw at said one end with an adjusting worm gear for advancing said movable jaw toward and away from said fixed jaw, the improvement comprising:

an elongated cavity in said handle;

a shaft having at least one helical groove rotatably supported within said cavity including a drive gear at one end engageable with said worm gear and a bearing member at an opposite end thereof;

said handle including elongated slots extending along opposite sides of said cavity; and actuator means insertable into each of said slots into engagement with said helical groove whereby movement of one or both said actuating means along said slots imparts rotation to said drive shaft and drive gear to rotate said worm gear.

2. In a wrench according to claim 1, each of said actuating means including a boss projecting through said slot into engagement with said helical groove, said bosses disposed in longitudinally offset relation to one another.

3. In a wrench according to claim 1, said drive shaft including a pair of helical grooves extending in juxtaposed relation to one another along said drive shaft, one of said actuating means engageable with one of said grooves and another of said actuating means engageable with another of said grooves.

4. In a wrench according to claim 3, each of said actuating means including a boss projecting through a respective slot, said bosses aligned in diametrically opposed relation to one another, and a thumb button on one end of said boss.

5. In a wrench according to claim 1, wherein each of said actuating means is defined by a slide button having a boss inserted through a respective slot into engagement with said helical groove.

6. In a wrench according to claim 1, wherein said worm gear has a bevel gear of generally semi-spherical configuration at one end, and said drive gear at said one end of said one shaft is of generally semi-spherical configuration complementary to said bevel gear.

7. In a wrench according to claim 1, wherein said handle includes cover plates with said elongated slots extending lengthwise of said cover plates and said actuating means are mounted on each of said cover plates.

8. An actuating mechanism for an open-ended, adjustable jaw wrench of the type having an elongated handle with a fixed jaw and a movable jaw at one end and a worm for advancing said movable jaw toward and away from said fixed jaw, said actuating mechanism comprising:

an elongated cavity in said handle;

a shaft having a helical groove rotatably supported within said cavity including a drive gear at one end engageable with said worm gear and a bearing member at an opposite end thereof;

said handle including elongated slots extending along opposite sides of said cavity; and a thumb button actuator member insertable into each of said slots into engagement with said helical groove whereby movement of one or both of said thumb button actuating members along said slots imparts rotation to said drive shaft and drive gear to rotate said worm.

9. An actuating mechanism according to claim 8, each of said thumb button actuating members including a boss projecting through said slot into engagement with said helical groove, said bosses disposed in longitudinally offset relation to one another.

10. An actuating mechanism according to claim 8, said drive shaft including a pair of helical grooves extending in juxtaposed relation to one another along said drive shaft, one of said thumb button actuating members engageable with one of said grooves and another of said thumb button actuating members engageable with another of said grooves.

11. An actuating mechanism according to claim 10, each of said thumb button actuating members including a boss projecting through a respective slot, said bosses aligned in diametrically opposed relation to one another.

* * * * *